United States Patent [19]

Yuhara et al.

[11] Patent Number: 5,050,623

[45] Date of Patent: Sep. 24, 1991

[54] VANITY CASE

[75] Inventors: Yukitomo Yuhara, Abiko; Yoshiharu Hatakeyama, Tokyo, both of Japan

[73] Assignee: Yoshida Industry Co., Ltd., Tokyo, Japan

[21] Appl. No.: 143,055

[22] Filed: Jan. 12, 1988

[30] Foreign Application Priority Data

| | | | |
|---|---|---|---|
| Jan. 21, 1987 | [JP] | Japan | 62-5976[U] |
| Apr. 24, 1987 | [JP] | Japan | 62-61439[U] |
| Aug. 24, 1987 | [JP] | Japan | 62-127402[U] |
| Sep. 10, 1987 | [JP] | Japan | 62-137470[U] |
| Sep. 11, 1987 | [JP] | Japan | 62-138314[U] |

[51] Int. Cl.[5] ..... A45D 42/02

[52] U.S. Cl. ..... 132/301; 132/293; 220/263

[58] Field of Search ..... 132/301-306, 132/293; 220/306, 326, 335, 260, 263

[56] References Cited

U.S. PATENT DOCUMENTS

| | | | |
|---|---|---|---|
| 4,276,893 | 7/1981 | Enomoto et al. . | |
| 4,331,168 | 5/1982 | Hatakeyama . | |
| 4,366,829 | 1/1983 | Yuhara . | |
| 4,392,503 | 7/1983 | Watanabe | 132/301 |
| 4,399,826 | 8/1983 | Ogasawara . | |
| 4,474,196 | 10/1984 | Yuhara . | |
| 4,483,355 | 11/1984 | Yuhara . | |
| 4,595,028 | 6/1986 | Yuhara . | |
| 4,679,576 | 7/1988 | Yuhara et al. . | |
| 4,683,899 | 8/1987 | Yuhara et al. . | |
| 4,696,317 | 9/1987 | Shioi et al. . | |

FOREIGN PATENT DOCUMENTS

| | | |
|---|---|---|
| 61-143502 | 7/1986 | Japan . |

*Primary Examiner*—Kenneth J. Dorner
*Assistant Examiner*—J. Hakomaki
*Attorney, Agent, or Firm*—Wenderoth, Lind & Ponack

[57] ABSTRACT

In a vanity case including a receptacle, a cover hinged with the receptacle and latch members for maintaining the cover in a closed position, a recess is formed in the marginal portion of the receptacle and is defined by an inner wall and side walls. An unlatching member includes an upper end and a body having a lower end, the upper end being connected to the cover at a position corresponding to the recess in such a manner as to permit the body to swing about the upper end, and the body extending downwardly to close the recess with the lower end abutting the inner wall of the recess when the cover is in the closed position. A slant surface is formed on at least one of the inner wall and the lower end, whereby an inwardly directed pressure to the body causes the cover to move upwardly.

21 Claims, 14 Drawing Sheets

FIG. 23A
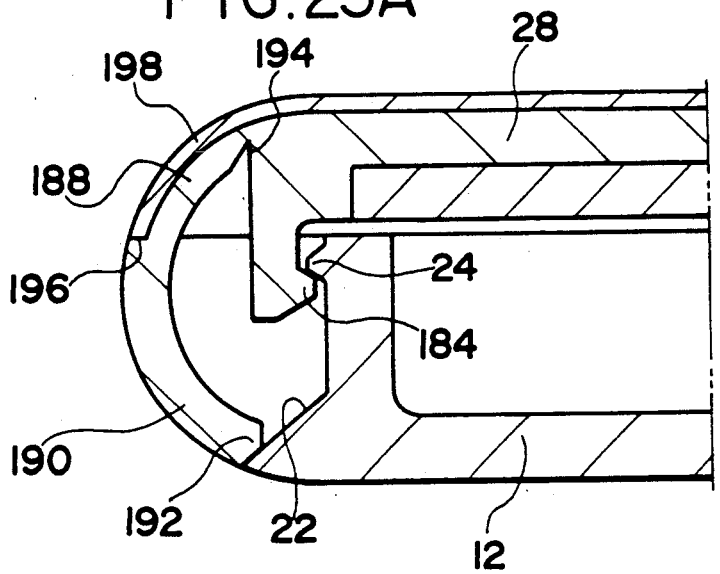
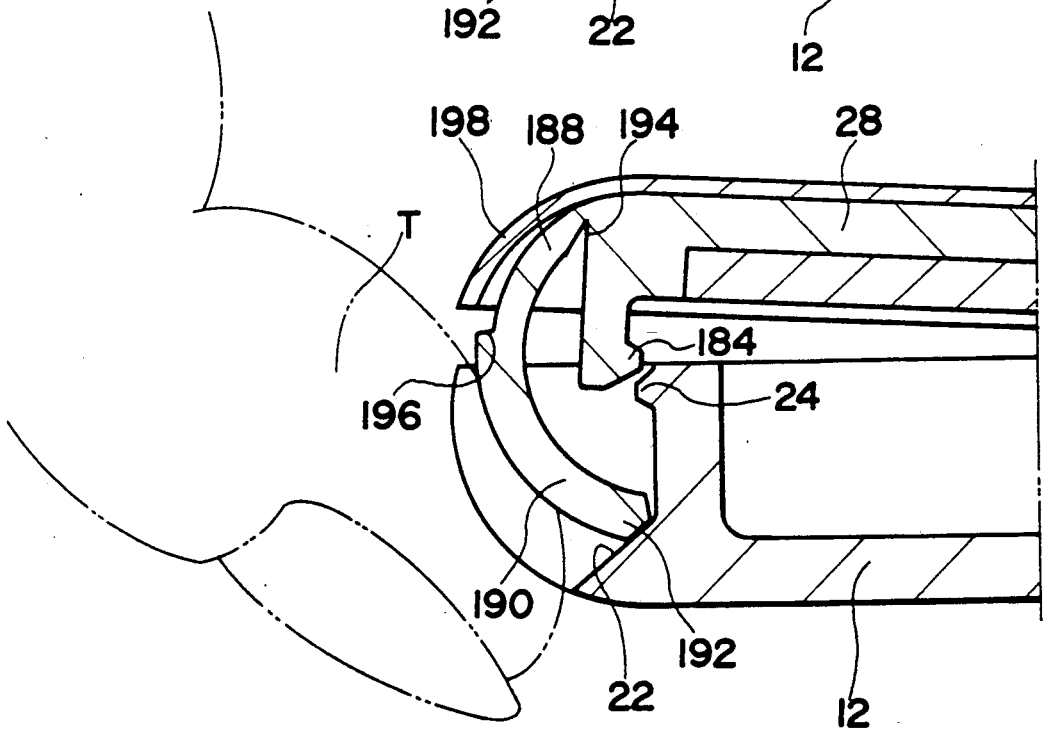
FIG. 23B

VANITY CASE

BACKGROUND OF THE INVENTION

1. Field of the Invention

The present invention relates to a vanity case of the type in which a receptacle member and a cover member are hinged together at respective rear ends thereof and the cover member is maintained in a closed position with respect to the receptacle member by engagement of latch means formed on the front ends of both members.

2. Description of the Prior Art

Various attempts and efforts have hitherto been made in order to facilitate an opening operation of the cover member, and a push piece has been proposed and found effective. For example, U.S. Pat. Nos. 4,276,893 and 4,399,826 disclose such a push piece arranged in a recess formed in a marginal portion of the receptacle member in a slidable manner (U.S. Pat. No. 4,276,893) or in a rotatable manner (U.S. Pat. No. 4,399,826), so that an inwardly directed pressure applied to the push piece urges the cover member upwardly to thereby release the engagement of the latch means. When it is desired to open the cover member, a user presses the push piece by, for example, a thumb of one hand. Then the front end of cover member is lifted up by using the other hand or by shifting the thumb to the front edge of the cover. It is thus necessary to use both hands or to perform two movements for opening the cover.

U.S. Pat. No. 4,331,168 discloses an arrangement of the push piece in the cover member, whereby the cover member can be opened by the same finger that presses the push piece. In this vanity case, however, a portion of the push piece to be pressed is located just above the upper edge of the receptacle member, so that the lower end of the user's finger which presses the push piece tends to come into contact with the upper edge of the receptacle member, resulting in difficulty in lifting up the cover by that finger without shifting it. In order to avoid such contact a delicate operation is required in positioning the finger on the push piece. Further, the pressure to the push piece is directed inwardly while the cover is to be opened upwardly. Therefore, the direction of pressure must be changed after the engagement of the latch means is released.

Also, it is known in the art to provide a tray between the receptacle and cover members for enabling the accommodation of a puff in addition to the cosmetic material. An example of such "three part" type vanity case is disclosed in Japanese Utility Model KOKAI No. 61143502 in which the tray as well as the cover is hinged with the receptacle at rear ends thereof. A push piece is arranged in the tray and adapted to release dual engagements between latch members of the cover and the tray and between latch members of the tray and the receptacle. However, as the push piece is mounted in the tray, separate action is required to open the cover after such engagements are released as in the above prior art vanity case.

Accordingly, an object of the present invention is to provide a vanity case having a push piece which can be pressed by a user's finger without delicate positioning of the finger.

Another object of the invention is to provide a vanity case in which a cover member can be opened to a desired angle simply by pressing a push piece continuously without changing the direction of the pressure.

SUMMARY OF THE INVENTION

According to the invention, a vanity case includes a receptacle member, a cover member hinged with the receptacle member at the rear end thereof, and latch means formed on the front ends of the receptacle and cover members for maintaining the cover member in a closed position with respect to the receptacle member. A recess is formed in a marginal portion of the receptacle member and is defined by an inner wall and side walls. Provided for releasing the engagement between latch means is unlatching means which includes an upper end and a body having a lower end. The upper end is connected to the cover member at a position corresponding to the recess in such a manner as to permit the body to swing or pivot about the upper end, while the body extends downwardly to close the recess with the lower end abutting the inner wall when the cover member is in the closed position. The vanity case further includes a slant surface formed on at least one of the inner wall of the recess and the lower end of the body, whereby an inwardly directed pressure applied to the body causes the cover member to move upwardly with respect to the receptacle member.

In one embodiment of the invention, the unlatching means comprises a push piece formed separately from the cover member. The cover member has formed in the marginal portion thereof a cut-out for accommodating the upper end of the push piece. The upper end may be formed flexible for permitting the swing movement of the body, or may be pivotted to the side walls defining the cut-out.

In another embodiment of the invention, the unlatching means comprises an unlatching member having the upper end formed integrally with the cover member. The upper end may comprise a flexible portion of the cover member.

Other objects, features and advantages of the invention will be apparent from the following detailed description thereof when taken in conjunction with the accompanying drawings.

BRIEF DESCRIPTION OF THE DRAWINGS

FIG. 23A is a fragmentary sectional view thereof with a cove member being closed; and FIG. 23B is a similar view showing an operation of an unlatch member.

DETAILED DESCRIPTION OF THE INVENTION

Figure 1:
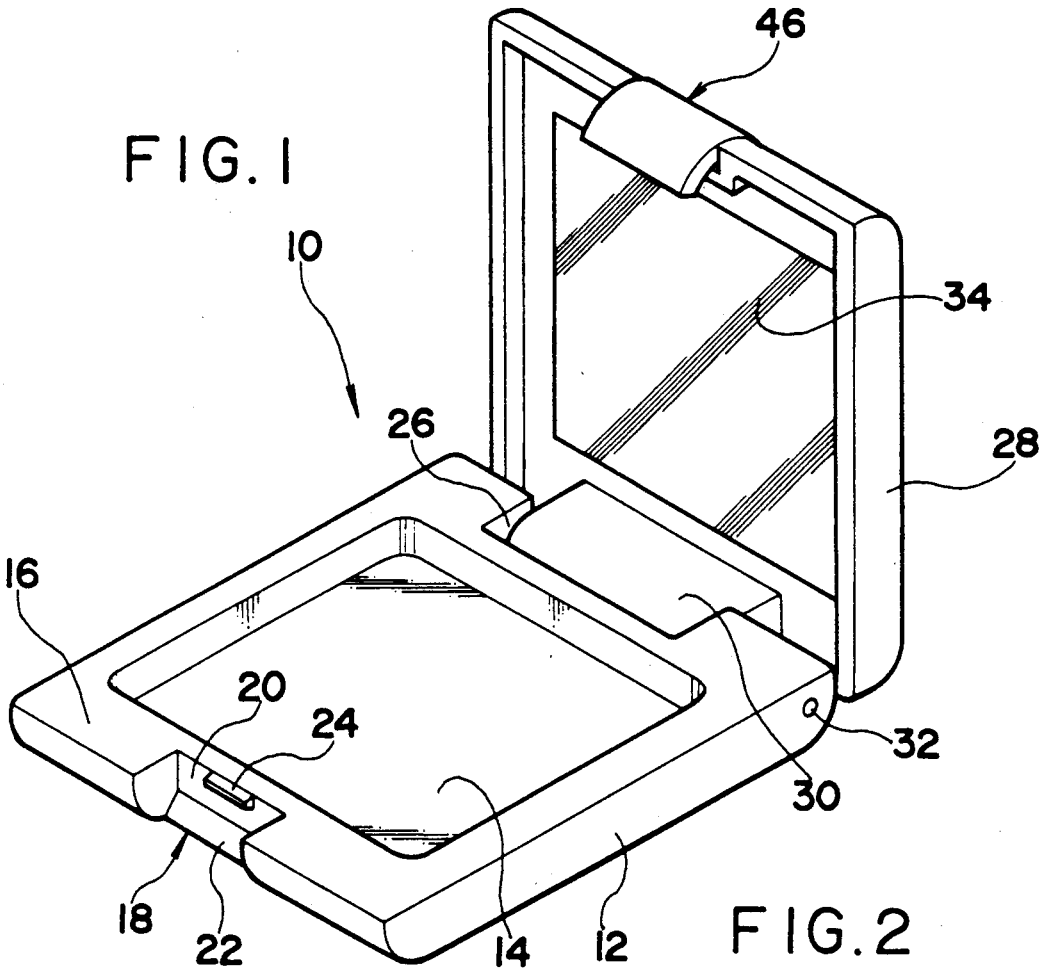
FIG. 1 is a perspective view illustrating a vanity case according to an embodiment of the invention, with a cover member being open.

Referring first to FIGS. 1 to 4 of the drawings, a vanity case 10 includes a receptacle member 12 having formed in the upper surface thereof a concave portion 14 for containing cosmetic material. The receptacle 12 is of a rectangular or square shape in plan view with its front and rear end walls being rounded. The front marginal portion 16 of the receptacle 12 is centrally cut away to form a recess 18 which fully opens in upward and forward directions and partially opens in a downward direction. Thus, the recess 18 is defined by side walls and an inner wall, the latter comprising an upper vertical surface 20 and a lower slant surface 22 inclined forwardly toward its lower edge which is a part of the bottom surface of the receptacle 12. A first latch tongue 24 is formed on the vertical surface 20 to project forwardly therefrom. The rear marginal portion of the receptacle 12 is centrally recessed to define a space 26 in which a hinge piece 30 of a cover member 28 is fitted. The cover 28 is thus hinged with the receptacle 12 by a pin 32.

Figure 2:
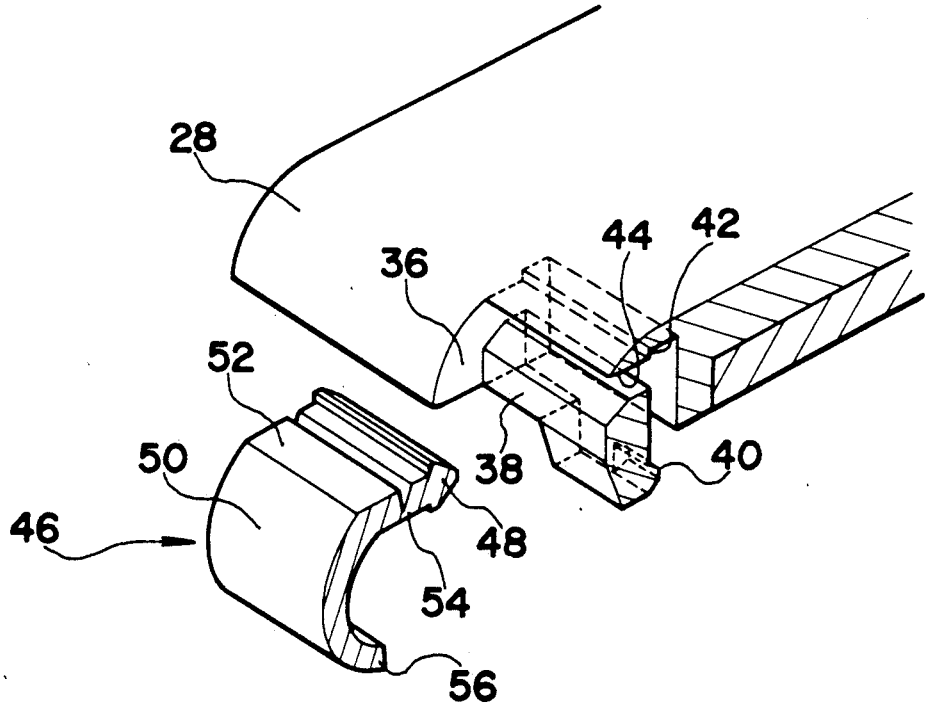
FIG. 2 is an enlarged perspective view showing a push piece attachment to the cover member.
Figure 3:
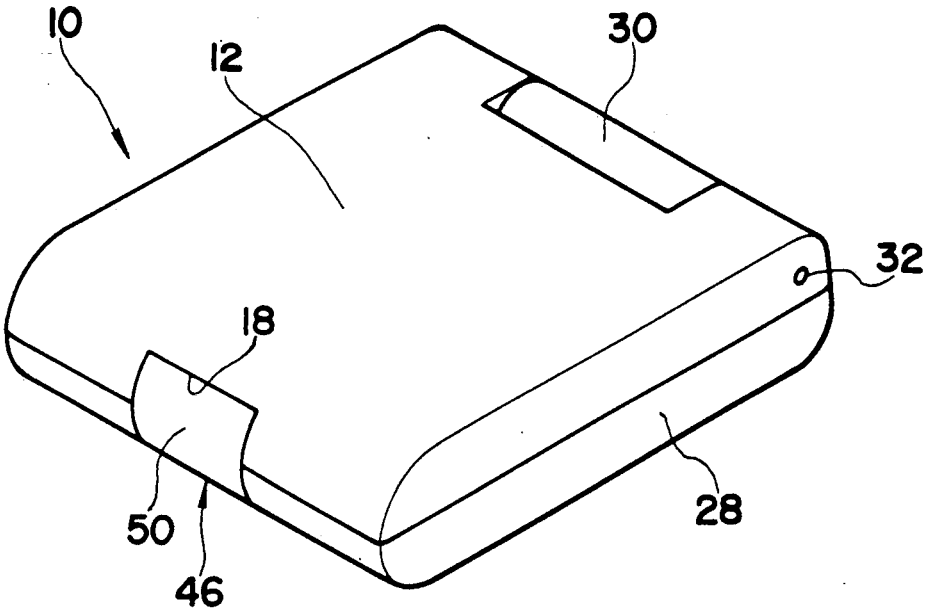
FIG. 3 is a perspective view of the vanity case of FIG. 1 with the cover member being closed and as seen from the bottom.

A mirror 34 is attached to the lower surface of the cover 28. The cover 28 has a shape corresponding to the shape of the receptacle 12 and its front and rear end walls are rounded so as to form round ends of the vanity case in cooperation with the end walls of the receptacle 12. As best shown in FIG. 2, the front end wall of the cover 28 is cut out at 36 and a pawl 38 extends between the side walls defining the cut-out 36. The pawl 38 extends downwardly to provide at its lower end an inwardly or rearwardly projected second latch tongue 40 which is adapted to engage with the first tongue 24 when the cover 28 is closed over the receptacle 12 and the pawl 38 enters into the recess 18, thereby maintaining the cover 28 in the closed position as shown in FIGS. 3 and 4.

The inner portion of the cut-out 36 is enlarged by a step 42 formed on the upper surface thereof at a position adjacent to a gap 44 above the upper end of the pawl 38. A head 48, in the form of an arrow in cross section, of a push piece 46 is forcedly inserted into the inner portion of cut-out 36 through the gap 44 and is engaged with the step 42 as shown in FIG. 4. The push piece 46 includes a rounded body 50 an upper end of which is connected to the head 48 via a flat portion 52. The entire push piece 46 is integrally molded of plastic material having sufficient flexibility so that a notch 54 on the flat portion 52 permits the round body 50 to swing or pivot when a pressure is applied thereto.

The round body 50 extends generally downwardly in such a manner that it closes the cut-out 36 of cover 28 and the recess 18 of receptacle 12, and that a lower end 56 of body 50 abuts and rests on the lower edge of slant surface 22 of the recess 18. The body 50 has the same curvature as the front end walls of the receptacle 12 and cover 28 in order to make the outer surface of body 50 flush with the end walls as illustrated in FIG. 3.

Figure 4:
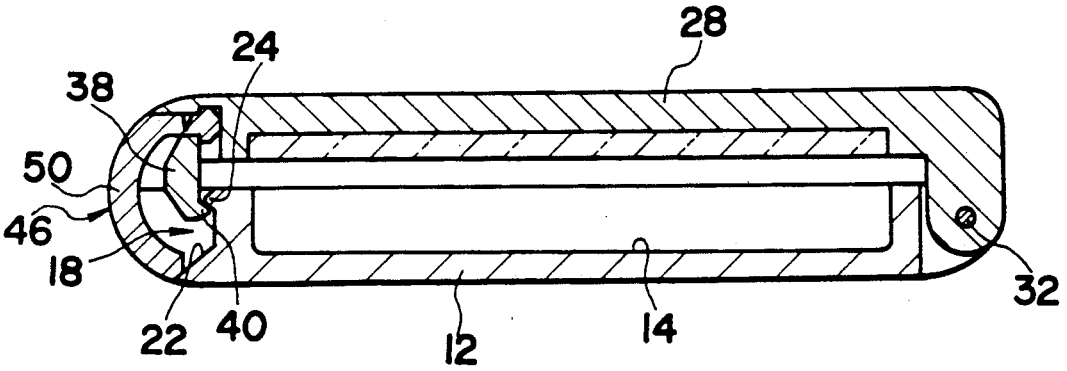
FIG. 4 is a longitudinal sectioned view thereof.
Figure 5:
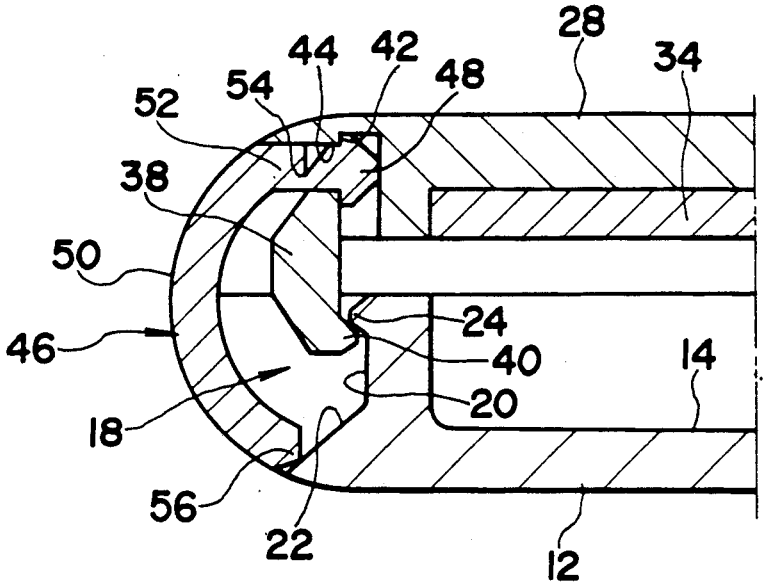
FIG. 5 is an enlarged fragmentary view thereof.
Figure 6:
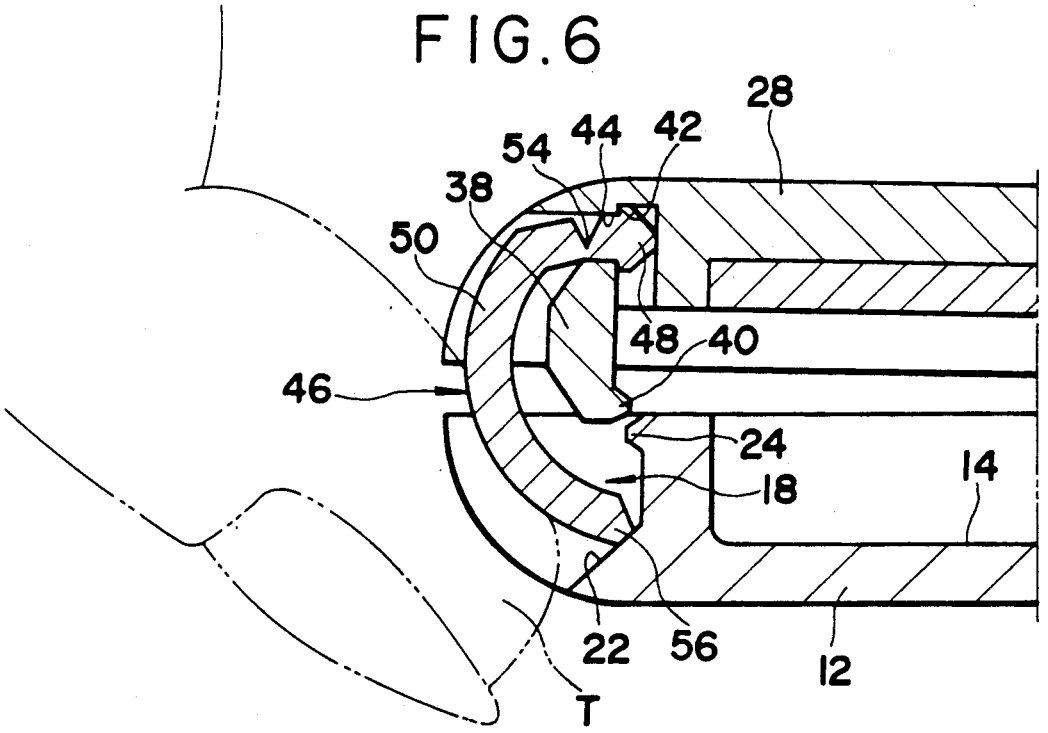
FIG. 6 is a view similar to FIG. 5 showing an operation of the push piece.

Assuming that the cover 28 is in the closed position of FIGS. 4 and 5, when it is desired to open the cover, a user's finger such as a thumb T is put onto the lower portion of body 50 of the push piece 46 to apply a pressure thereto in upward and rearward directions. This pressure causes the body 50 to swing or pivot about the notch 54 with the lower end 56 sliding on the slant surface 22. As a result, an upwardly directed reaction force is applied to the cover 28 to which the head 48 of push piece 46 is secured, whereby the second tongue 40 is disengaged from the first tongue 24 to release the lock of the cover 28, as shown in FIG. 6. Thereafter, the cover 28 can be opened to a desired angle simply by continuously applying the pressure to the body 50. The push piece 46 will return to its normal shape when the pressure is removed, and the second latch tongue 40 will again be engaged with the first one by snap action when the cover 28 is closed over the receptacle 12.

During the above opening operation, a user may first put her finger onto the front end, i.e. longitudinal center, of the round body 50 and then apply the end of that finger to the lower portion of the body. Therefore, no delicate operation is required to locate the finger in position. In addition, the pressure required for releasing the engagement between the latch tongues 24 and 40 is substantially in the same direction as the force for opening the cover 28, which eliminates the need for shifting the user's fingers or changing the direction of pressure applied to the push piece.

Figure 7:
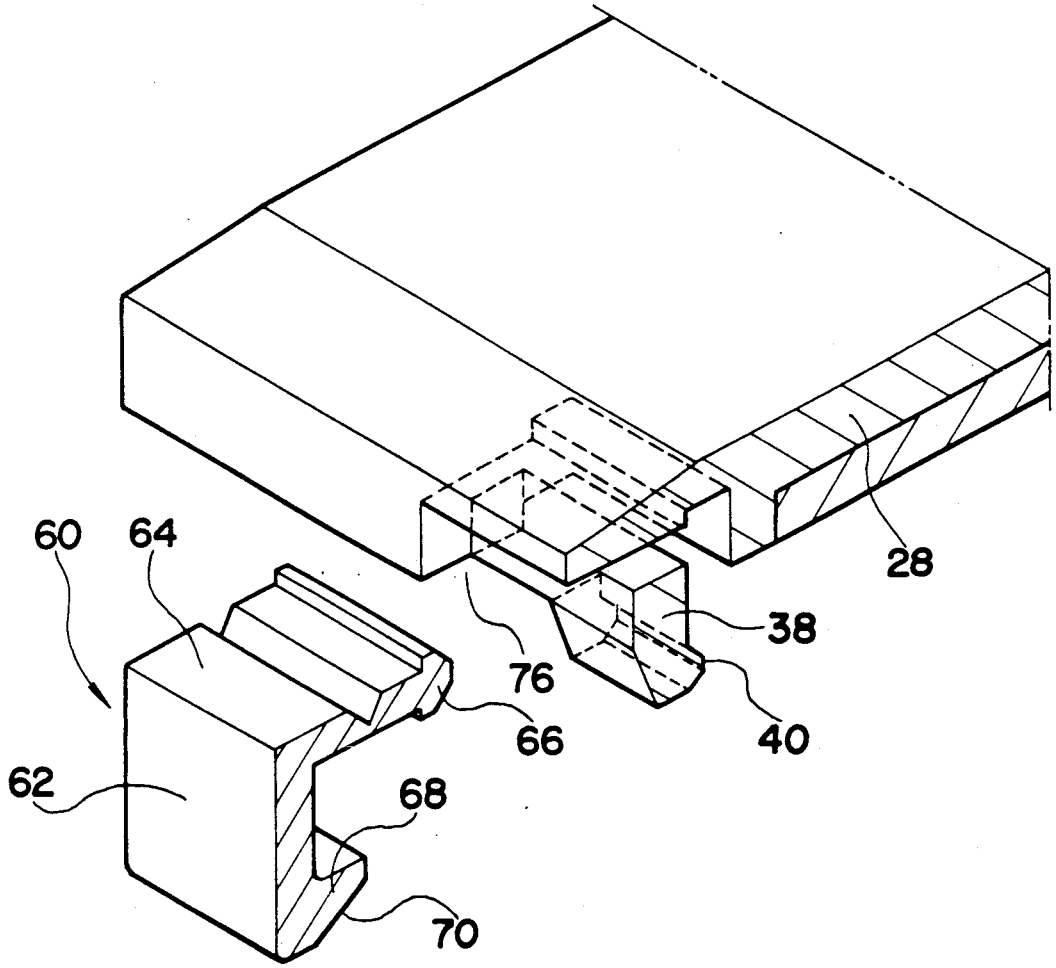
FIG. 7 is an enlarged perspective view illustrating a push piece according to another embodiment of the invention before attachment to a cover member.
Figure 8:
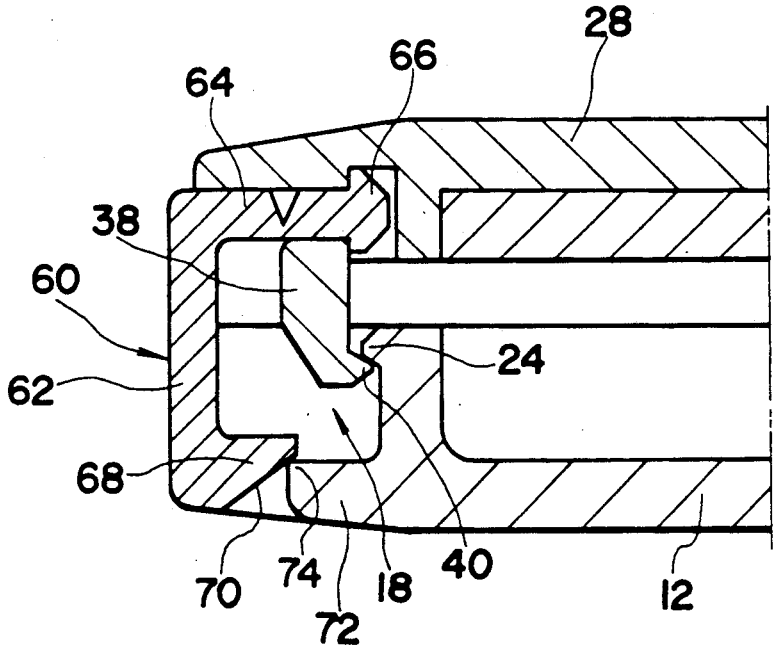
FIG. 8 a is fragmentary sectional view of a vanity case of FIG. 7.
Figure 9:
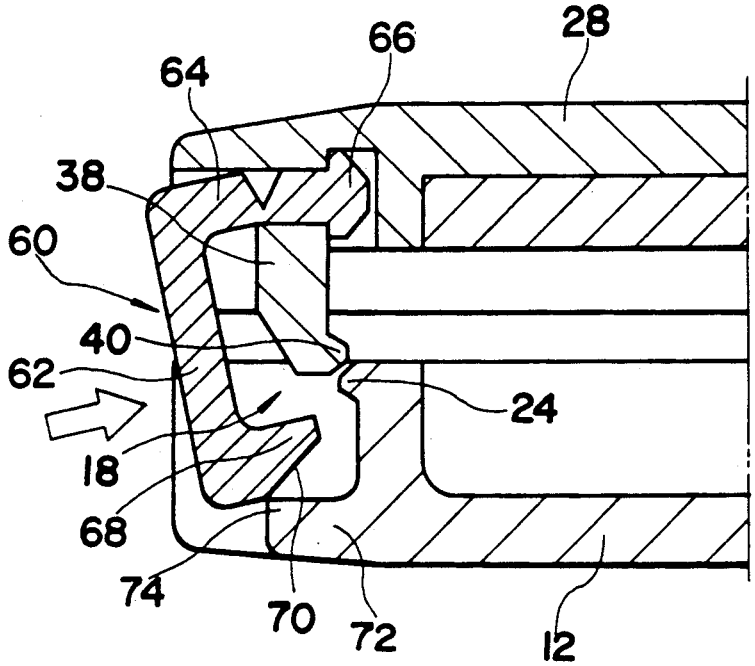
FIG. 9 is a similar view showing an operation of the push piece.

In an embodiment illustrated in FIGS. 7 to 9, a push piece 60 has a body 62 extending downwardly and perpendicularly to a flat portion 64 connected to a head 66. The lower end of the body 62 projects rearwardly as at 68 to provide a lower slant surface 70 which is inclined upwardly toward its inner end. The inner wall defining the recess 18 of receptacle 12 includes a forward projection 72 terminating at an angled corner 74 which faces and substantially abuts the slant surface 70. The projection 72 may alternatively include an inclined upper surface to cooperate with the slant surface 70. A depression 76 is formed in the front lower surface of cover 28 for securing the head 66, and the body 62 closes the depression 76 and the recess 18 with its bottom being positioned at the same level as the bottom of receptacle 12. Other structures of this embodiment are substantially the same as those of the first embodiment.

In order to open the cover 28 from its closed position of FIG. 8, the lower portion of the body 62 is pressed upwardly and rearwardly as indicated by an arrow in FIG. 9. By such a pressure the slant surface 70 slides on the corner 74 to exert an upward force on the cover 28, so that the engagement between latch tongues 24 and 40 is released. A continuous pressure to the push piece 60 will open the cover 28 to a desired angle, as in the first embodiment.

Figure 10:
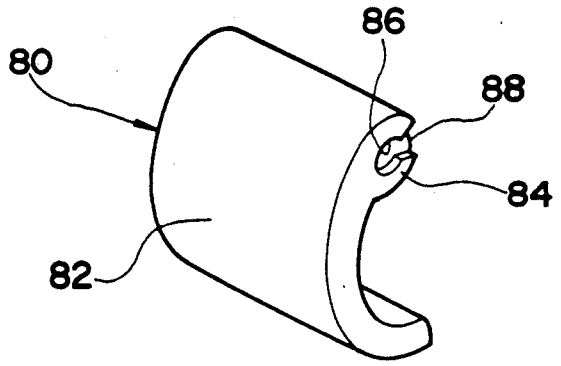
FIG. 10 is a perspective view of a push piece according to another embodiment of the invention.
Figure 11:
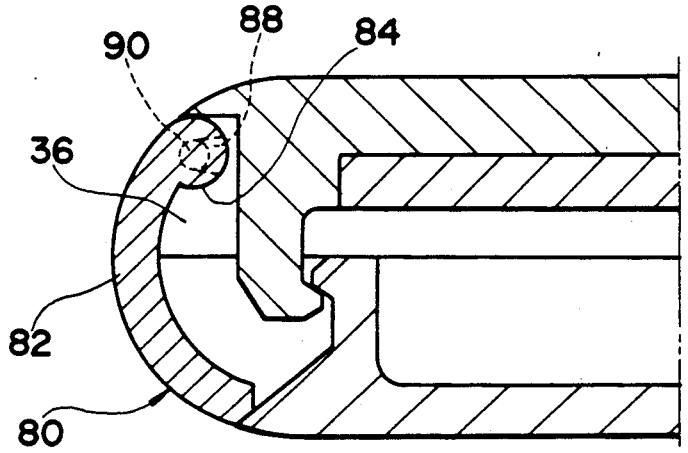
FIG. 11 is a fragmentary sectional view of a vanity case having the piece of FIG. 10.

The swing motion of the push piece can be achieved also by means of a pivot. An example thereof is illustrated in FIGS. 10 and 11, in which a push piece 80 comprises a rounded body 82 having an enlarged upper end 84. Formed in each side of the upper end 84 are a circular recess 86 and a slit 88 that is connected to the recess 86 and is gradually enlarged to the rear edge of the upper end 84. A boss 90 is provided on each side wall defining the cut-out 36 and is fitted into the respective recess 86 through the respective slit 88, whereby the push piece 80 can swing about the bosses 90. The push piece 80 may be formed of relatively stiff material.

Figure 12:
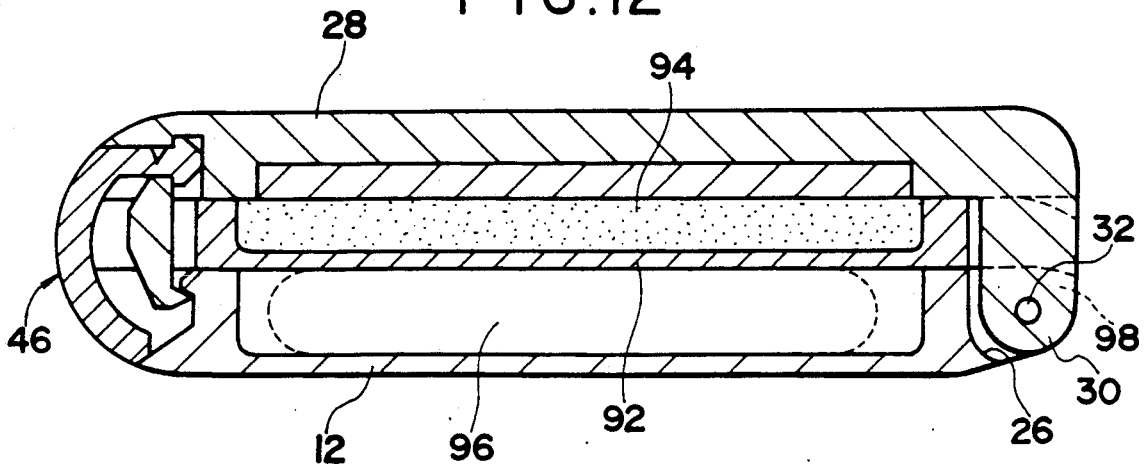
FIG. 12 a longitudinal section of a vanity case according to another embodiment of the invention.
Figure 13:
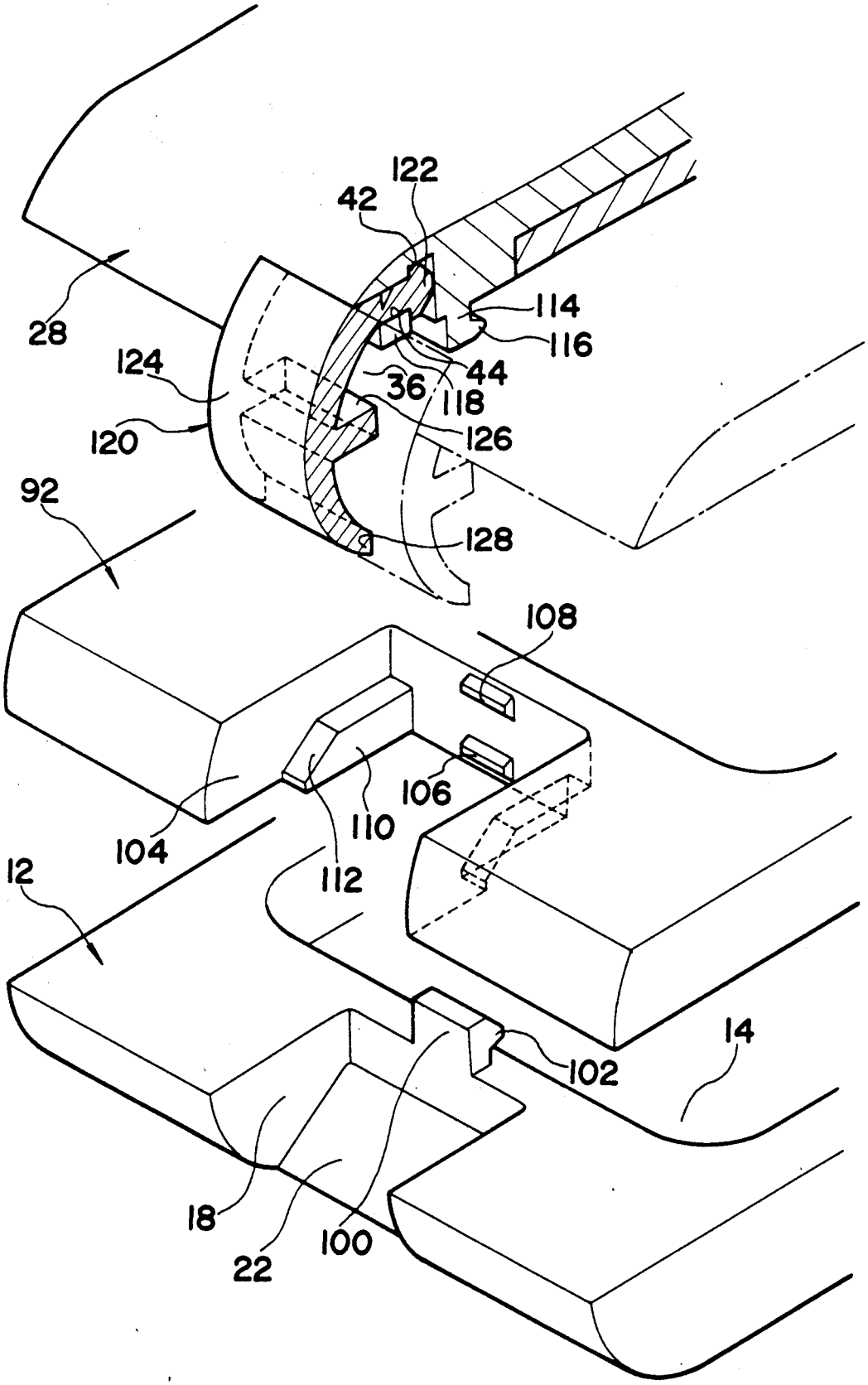
FIG. 13 is a perspective view showing various parts of a vanity according to still another embodiment of the invention.

If desired, a tray 92 for containing cosmetic material 94 may be disposed between the cover 28 and receptacle 12 within which a puff 96 is received, as shown in FIG. 12. The tray 92 has at its rear ends a pair of spaced hinge pieces 98 fitted in the space 26 of the receptacle 12 for connection therewith by the pin 32 which also connects the hinge piece 30 of the cover 28.

A modified form of this "three-part" type vanity case is illustrated in FIGS. 13 through 15C. The receptacle 12 has formed on the front upper surface thereof a nose 100 having an upper end that projects rearwardly to form a first latch tongue 102, the front surface of nose 100 being flush with the inner wall defining the recess 18. The tray 92 has at its front marginal portion a second recess 104 which is aligned with the recess 18 when the tray 92 is closed over the receptacle 12. The second recess 104 is formed larger than the recess 18 and is defined by an inner vertical wall on which are formed at the lower portion thereof a third latch tongue 106 adapted to be engaged with the first latch tongue 102 of the receptacle 12, and at the upper portion thereof a fourth latch tongue 108 adapted to engage with a second latch tongue 116 of the cover 28 as hereinafter described. The second recess 104 is further defined by side walls which include guide members 110 extending forwardly from the inner wall to terminate at oblique surfaces 112. Each oblique surface 112 is inclined in the same direction as the slant surface 22 of the cover 12 with less inclination than the latter.

Figure 14:
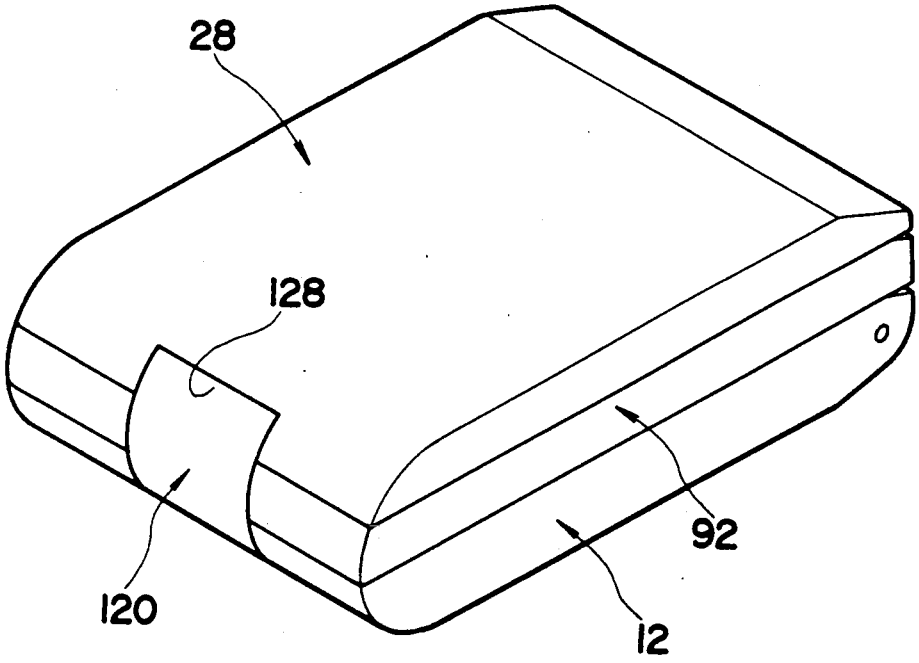
FIG. 14 is a perspective view of the vanity case of FIG. 13 showing a closed state thereof.

The cut-out 36 of the cover 28 is formed at a position aligned with the recesses 18 and 104 when the cover is closed over the tray 92, and is defined by the inner wall forming a pawl 114 which has at its lower end the second latch tongue 116 for engagement with the fourth latch tongue 108 of the tray 92. A lateral bar 118 extends between side walls of the cut-out 36 to provide the gap 44 which cooperates with the step 42 for securing a head 122 of a push piece 120. This push piece 120 has features similar to those of the push piece 46 of the first embodiment except that a rounded body 124 thereof includes a rearwardly or inwardly extending projection 126 formed at a substantially longitudinal center of the body 124. When the cover 28 and the tray 92 are in their closed positions, the rounded body 124 closes the cut-out 36, the second recess 104 and the recess 18 and its lower end 128 rests on the lower edge of slant surface 22, as shown in FIG. 14. In that state, the rear end of projection 126 is adjacent to the lower ends of oblique surfaces 112 of the tray 92 as seen from FIG. 15A.

Figure 15A:
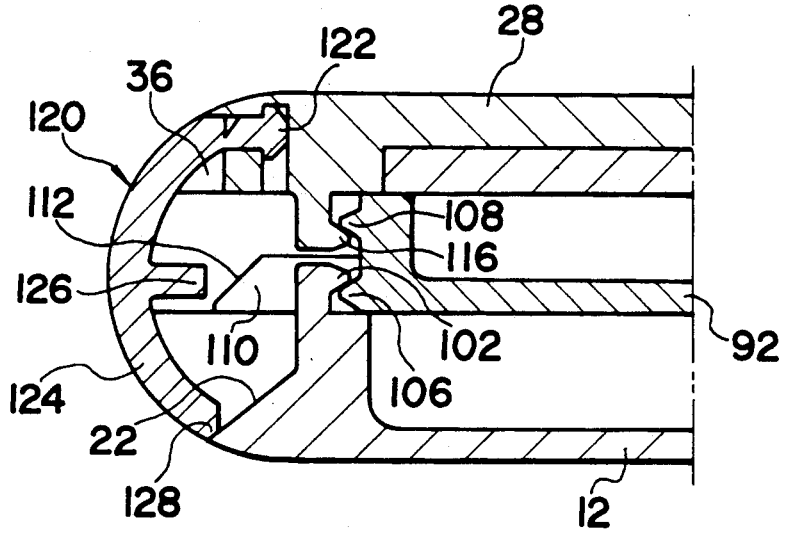
FIG. 15A is a fragmentary sectional view thereof.
Figure 15B:
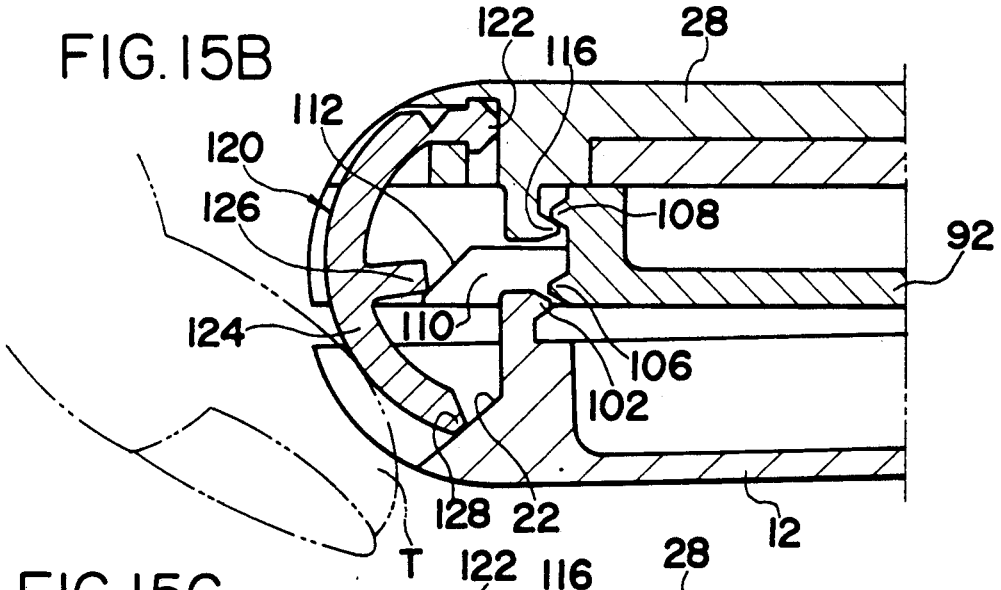
FIGS. 15B and 15C are similar views showing an operation of a push piece.
Figure 15C:
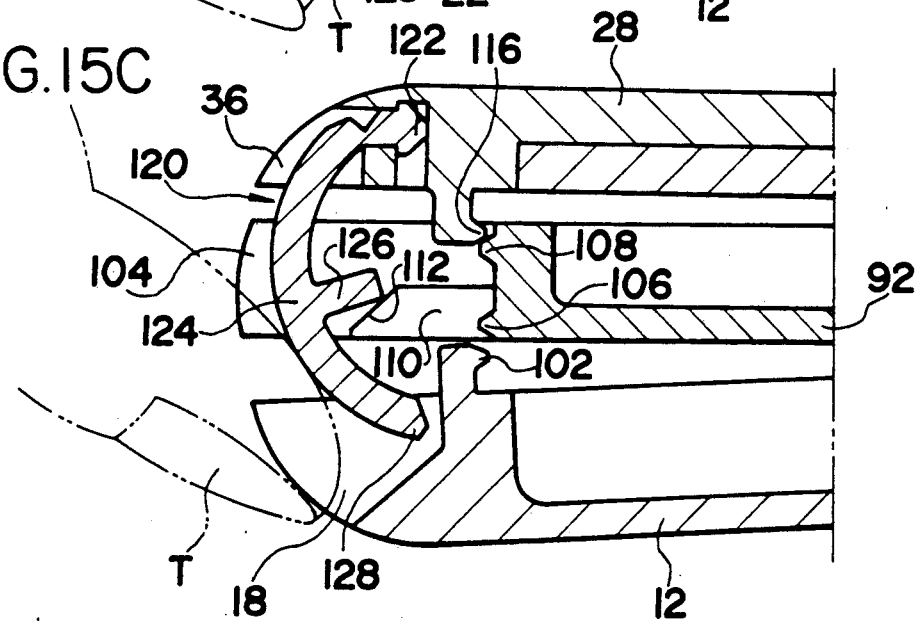

When the lower portion of rounded body 124 of the push piece 120 is pressed inwardly and upwardly by, for example, a thumb T of a user's right hand, the lower end 128 slides upon the slant surface 22 of receptacle 12 to exert such a force as to push up the cover 28 to which the head 122 of push piece 120 is fixed. Accordingly, the cover 28 and the tray 92 (which is engaged with the cover at the latch tongues 108 and 116) are urged upwardly, resulting in releasing the engagement between the first and third latch tongues 102 and 106 as illustrated in FIG. 15B. At the same time the projection 126 abuts against the oblique surfaces 112, and further deformation of the push piece 120 causes the cover 28 to move upwardly relative to the tray 92 by the projection 126 sliding on the oblique surface 112. Therefore, the second latch tongue 116 of the cover 28 is disengaged from the fourth latch tongue 108 of the tray 92 as shown in FIG. 15C, so that a continuous pressure to the push piece 120 may open the cover 28 to any desired angle. The gentle inclination of the oblique surfaces 112 as compared with the slant surface 22 permits the tray 92 to first disengage from the receptacle 92 and then from the cover 28.

Figure 16A:
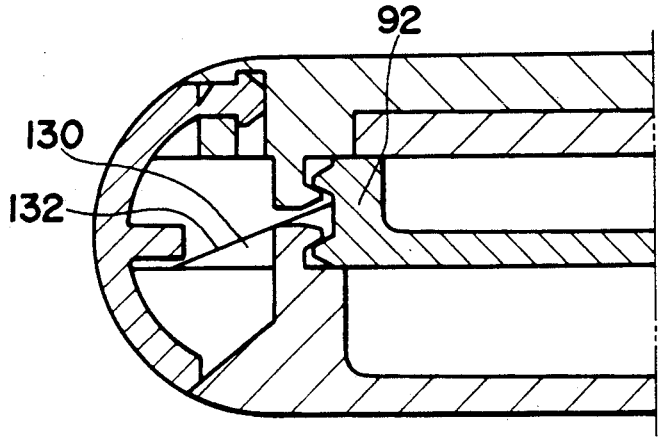
FIGS. 16A and 16B are views showing modified forms of the vanity case of FIG. 15A.
Figure 16B:
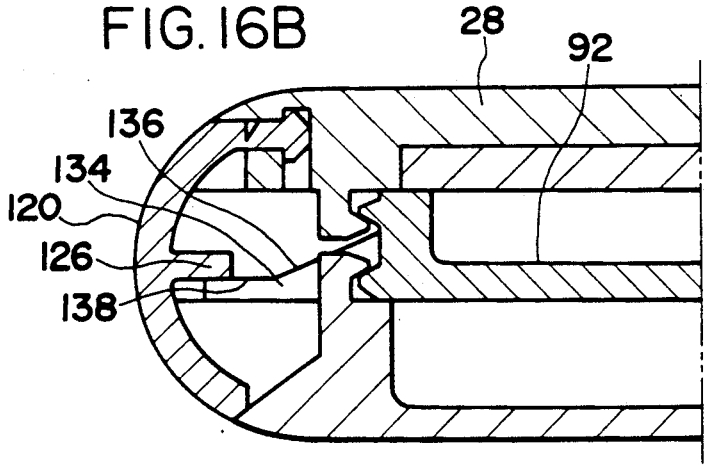

FIGS. 16A–16B illustrate slightly modified forms of the above embodiment. In FIG. 16A, the tray 92 has guide members 130 upper surfaces 132 of which are inclined throughout their length. On the other hand, a guide member 134 of FIG. 16B has an upper surface which comprises an oblique portion 136 extending downwardly from the inner wall of the second recess 104 and a flat portion 138 extending forwardly from the end of the portion 136. The rear end of projection 126 normally rests on the front end of flat portion 138 so that, during an initial stage of the opening operation, the push piece 120 does not exert a force to move the cover 28 upwardly with respect to the tray 92.

Figure 17:
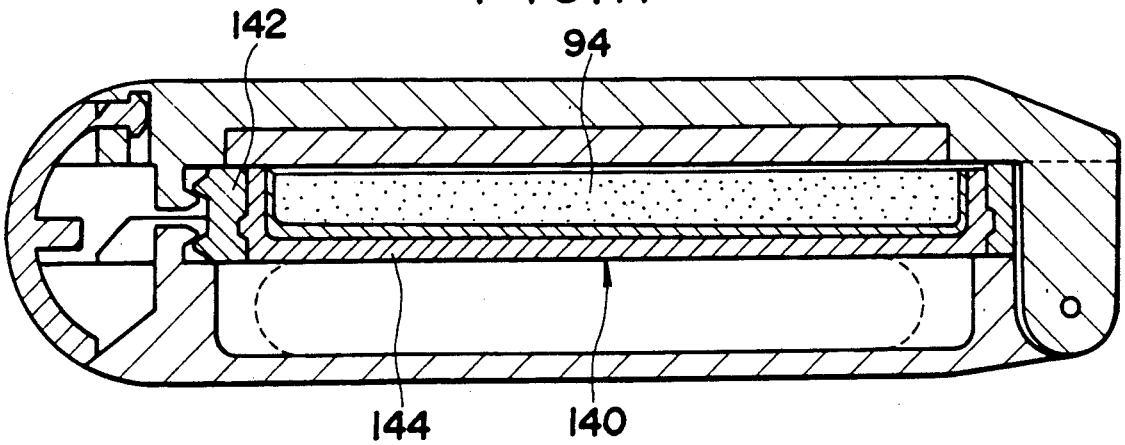
FIG. 17 is a longitudinal section of a vanity case having a tray modified from that of FIG. 15A.
Figure 18:
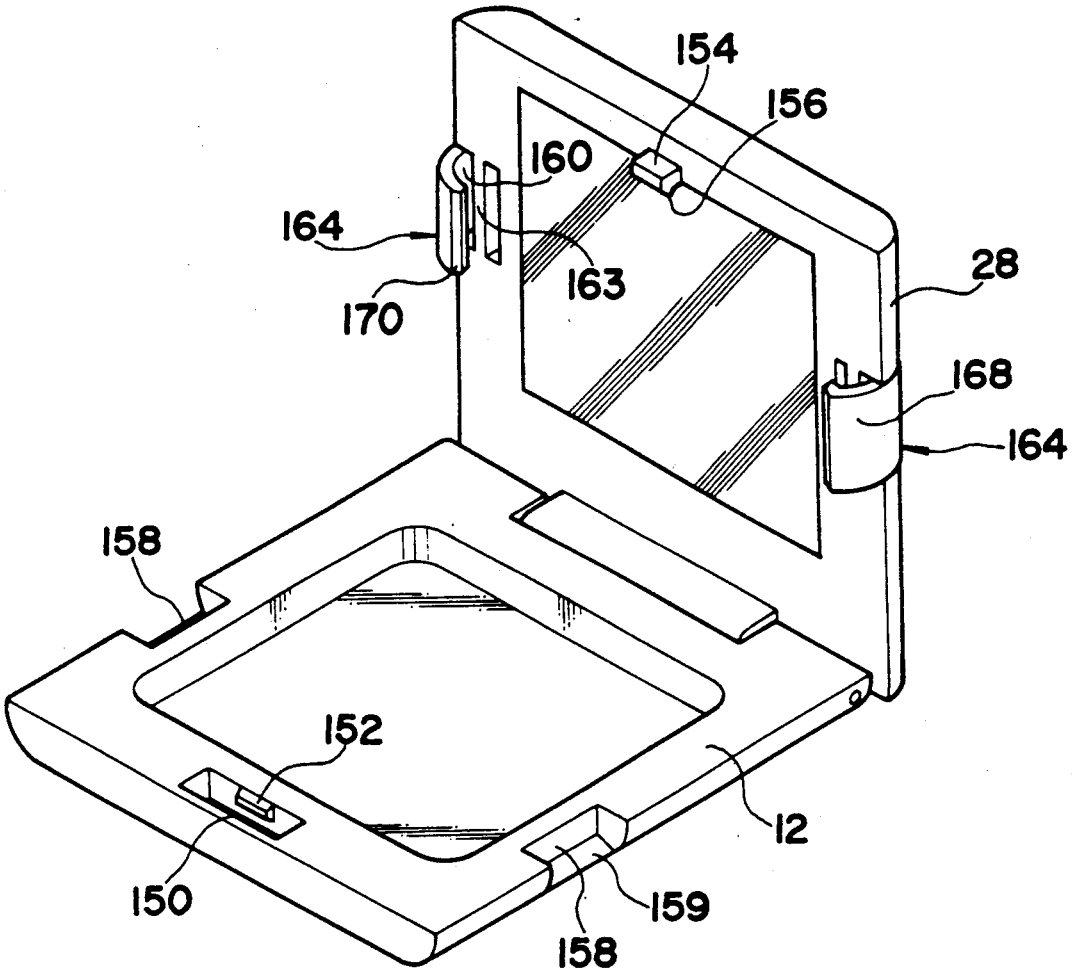
FIG. 18 is a perspective view illustrating a vanity case according to yet another embodiment of the invention, with a cover member being opened.

If desired, the tray may comprise two, separate members as shown in FIG. 17. This tray 140 includes a frame 142 forming a peripheral portion of the tray and a container 144 fitted in the frame 142 in a detachable manner for the purpose of refilling the cosmetic material 94.

FIGS. 18 to 21 illustrate another embodiment of the vanity case, which is different from the above embodiments mainly in that the push piece is arranged at the side portion of the vanity case. Specifically, the receptacle 12 is formed at its front marginal portion with a depression 150 in which a first latch tongue 152 is provided, and is hinged with the cover 28 at the respective rear ends thereof. A pawl 154 extends downwardly from the front lower surface of cover 28 and has a second latch tongue 156 which is adapted to engage with the first latch tongue 152 when the cover is closed over the receptacle. The side walls of receptacle 12 and cover 28 are rounded.

Figure 19:
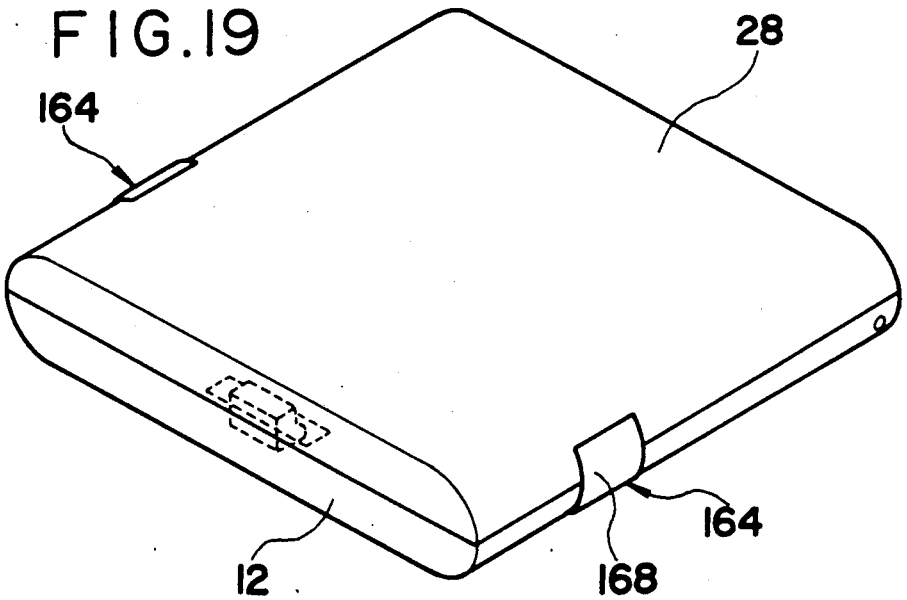
FIG. 19 is a perspective view of the vanity case of FIG. 18 with the cover member being closed.
Figure 20A:
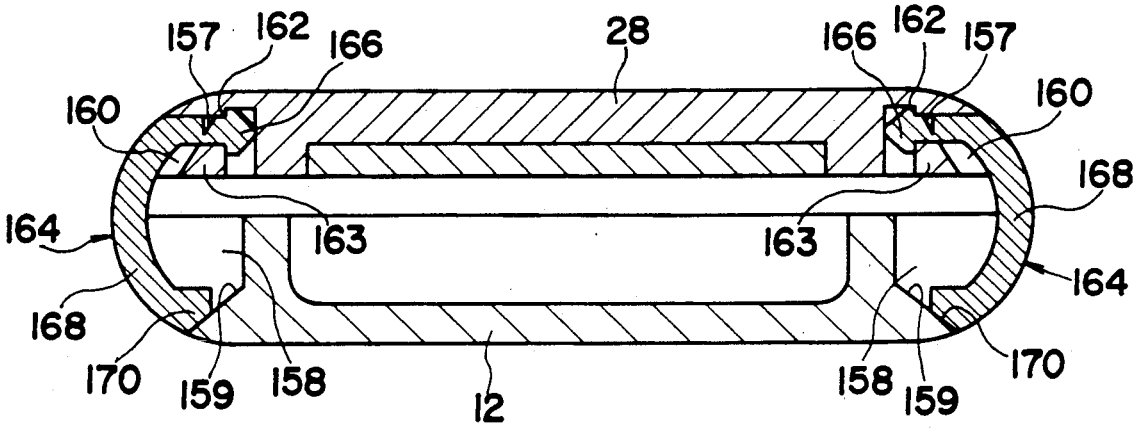
FIG. 20A is a transverse section thereof.

A pair of recesses 158 are formed in the side portions of receptacle 12, each recess being similar to the recess 18 of FIG. 1 except that no latch tongue is provided on the inner wall. Corresponding to these recesses the cover 28 is provided with recesses or cut-out portions 160 each of which includes a step 162 and a bar 163 for engaging a head 166 of push piece 164. As in the first embodiment, each push piece 164 comprises a rounded body 168 which closes the respective cut-out 160 and the recess 158, with its external surface being flush with the side walls of the vanity case and its lower end 170 abutting a slant surface 159 defining the respective recess 158, when the cover 28 is in the closed position as illustrated in FIGS. 19 and 20A.

Figure 20B:
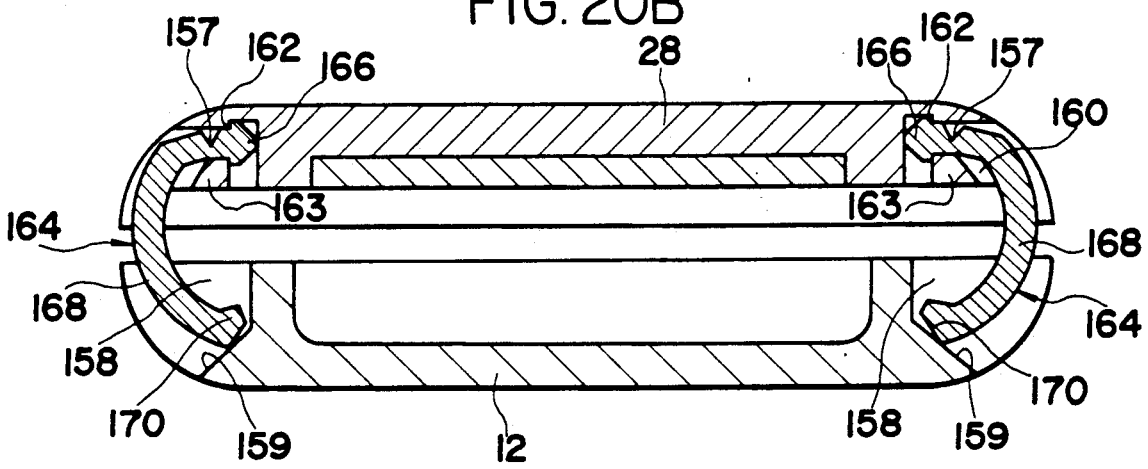
FIG. 20B is a similar view showing an operation of push pieces.
Figure 21:
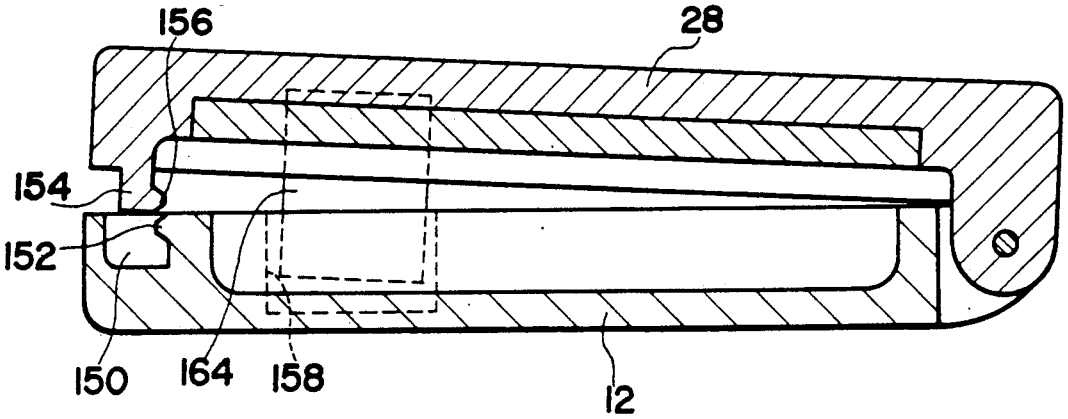
FIG. 21 is a longitudinal section of the vanity case of FIG. 18 with the cover member being in a position of FIG. 20B.

In order to open the cover 28, two fingers such as a thumb and a forefinger are placed on the lower portions of rounded bodies 168 to apply inwardly and upwardly directed pressures thereto. Such pressures cause the push pieces 164 to swing about notches 167 with the lower ends 170 sliding on the respective slant surface 159 as shown in FIG. 20B, to thereby exert a force to push up the cover 28 with respect to the receptacle 12. Therefore, the engagement between the latch tongues 152 and 154 is released (FIG. 21), and continuous pressures to the push pieces 164 will open the cover 28 to a desired angle.

Although it is preferable to provide the push pieces at both sides of the vanity case as in the illustrated embodiment, a single push piece provided at one side of the vanity case may be sufficient.

Figure 22:
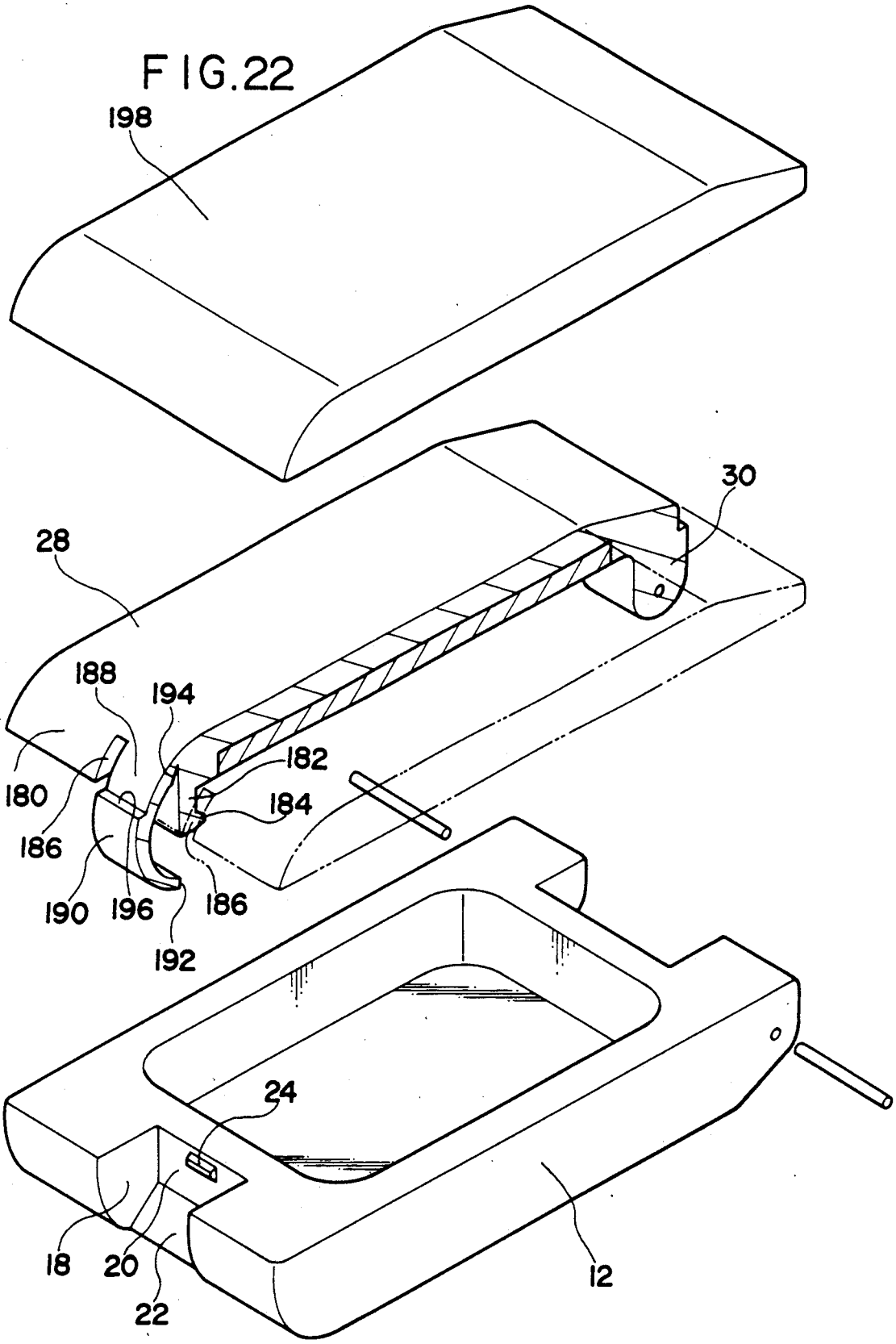
FIG. 22 is an exploded perspective view illustrating a vanity case according to further embodiment of the invention.

Also, in all of the above embodiments the push piece formed separately from the cover is used to act as unlatching means, but it may be formed integrally with the cover as illustrated in FIGS. 22–23B. That is, the front end wall 180 of cover 28 is rounded and is formed relatively thin. A downwardly extending pawl 182 is spaced from the end wall 180 and has a second latch tongue 184 adapted to engage with the first latch tongue 24 on the inner wall 20 defining the recess 18 of the receptacle 12. The front end wall 180 is formed with a pair of spaced slits 186 extending rearwardly from the front edge for affording flexibility to a portion 188 defined between the slits 186. An unlatching member 190 formed integrally with the portion 188 extends generally downwardly with the same curvature as the portion 188 and the front end wall of the receptacle 12, in such a manner that it closes the recess 18 with its lower end 192 abutting the lower edge of the slant surface 22 when the cover 28 is closed over the receptacle 12.

The wall thickness of portion 188 is reduced at its upper end by a notch 194 on the inner surface in order to enhance the flexibility of the portion 188 while the unlatching member 190 has a thickness sufficient to make it rigid, forming a step 196 on the outer surface between the unlatching member 190 and the portion 188. An enclosure 198 is fitted over the cover 28 except the unlatching member 190 and the hinge piece 30 so that the outer surface of the enclosure 198 becomes flush with that of the receptacle 12, and is adhered to the cover 28 except the portion 188. This enclosure 198 serves to improve the external appearance of the vanity case by concealing the slits 186 and protects the portion 188.

Similar to the above embodiments, the opening operation is carried out simply by pressing the lower portion of unlatching member 190 inwardly and upwardly by, for example, a thumb T of a user's right hand as shown in FIG. 23B. Such a pressure causes the unlatching member 190 to swing about the notch 194 with the lower end 192 sliding on the slant surface 22, resulting in pushing up the cover 28 and releasing the engagement between the latch tongues 24 and 184. The cover 28 will open to any desired angle by continuously pressing the unlatching member 190. The unlatching member 190 being integral with the cover 28 reduces number of parts of the vanity case and facilitates the assembly thereof.

Although the present invention has been described with reference to the preferred embodiments thereof, many modifications and alterations may be made within the spirit of the invention.

What is claimed is:

1. A vanity case comprising:

a receptacle member;

a cover member hinged with said receptacle member at rear ends thereof;

latch means formed on front ends of said receptacle member and said cover member for maintaining said cover member in a closed position with respect to said receptacle member;

a recess formed in a marginal portion of said receptacle member, said recess fully opening in upward and outward directions and partially opening in a downward direction and being defined by an inner wall and by side walls, said inner wall comprising an upper vertical surface and a lower slant surface inclined downwardly and forwardly toward a lower edge thereof; and unlatching means for releasing engagement of said latch means, said unlatching means including an upper end and a body having a lower end, said upper end being connected to said cover member at a position directly above said recess and inwardly offset from a peripheral edge of said cover member to permit said body to swing about said upper end, said body extending downwardly to close said recess with said lower end abutting said lower slant surface when said cover member is in said closed position, said body and marginal portions of said cover and receptacle members having equal curvatures such that the outer surface of said body is flush with outer surfaces of said marginal portions of said cover and receptacle members when said cover member is in said closed position;

whereby an inwardly directed pressure applied to said body causes said cover member to move upwardly with respect to said receptacle member.

2. A vanity case as claimed in claim 1, wherein said unlatching means comprises a push piece formed separately from said cover member, and wherein said cover member has formed in said marginal portion thereof a cut-out for accommodating said upper end of said push piece.

3. A vanity case as claimed in claim 2, wherein said upper end includes an enlarged head fixedly secured within said cut-out, and a notch for affording flexibility to said upper end and thereby permitting the swinging movement of said body.

4. A vanity case as claimed in claim 3, further comprising a bar extending between side walls defining said cut-out and a step formed on an upper wall of said cut-out, and wherein said enlarged head engages with said bar and said step.

5. A vanity case as claimed in claim 2, wherein said upper end of said push piece is pivotted to side walls defining said cut-out.

6. A vanity case as claimed in claim 2, further comprising a tray disposed between said receptacle member and said cover member and hinged with said receptacle member at rear ends thereof.

7. A vanity case as claimed in claim 6, wherein said latch means comprises a first latch member formed on said receptacle member and a second latch member formed on said cover member.

8. A vanity case as claimed in claim 7, wherein said first and second latch members are adapted to engage with each other.

9. A vanity case as claimed in claim 7, wherein said latch means further comprises a third latch member and a fourth latch member both formed on said tray, said third and fourth latch members being adapted to engage with said first and second latch members, respectively.

10. A vanity case as claimed in claim 9, further comprising means for urging said cover member upwardly with respect to said tray.

11. A vanity case as claimed in claim 10, wherein said urging means comprises a projection extending inwardly from said body of said push piece to abut a portion of said tray, and an oblique surface formed on at least one of the inner end of said projection and said portion of said tray.

12. A vanity case as claimed in claim 11, wherein said tray has a second recess formed at a position corresponding to said recess of said receptacle member, and wherein said portion of said tray comprises upper surfaces of guide members formed on side walls defining said second recess.

13. A vanity case as claimed in claim 12, wherein said upper surface of said guide members form said oblique surface.

14. A vanity case as claimed in claim 12, wherein said third and fourth latch members are formed on an inner wall defining said second recess, and wherein said receptacle member has an upwardly extending nose on which said first latch member is formed and said cover member has a downwardly extending pawl on which said second latch member is formed.

15. A vanity case as claimed in claim 1, wherein said unlatching means comprises an unlatching member having said upper end formed integrally with said cover member.

16. A vanity case as claimed in claim 15, wherein said upper end comprises a flexible portion of said cover member.

17. A vanity case as claimed in claim 16, wherein said flexible portion is defined between a pair of slits formed in said marginal portion of said cover member and includes a notch formed at the upper edge thereof.

18. A vanity case as claimed in claim 17, further including an enclosure fitted over said cover member, said enclosure being adhered to said cover member except said flexible portion.

19. A vanity case as claimed in claim 1, wherein said latch means comprises a first latch member formed on said receptacle member and a second latch member formed on the lower end of a pawl extending downwardly from said cover member, said first and second latch members being adapted to engage with each other.

20. A vanity case as claimed in claim 19, wherein said recess is formed in the front end of said receptacle member and wherein said first latch member is formed on said inner wall of said recess.

21. A vanity case as claimed in claim 19, wherein said recess is formed in at least one side portion of said receptacle member, and wherein said receptacle member further includes a depression formed in the front end thereof, said first latch member being formed on an inner wall defining said depression.

* * * * *